US006108922A

United States Patent [19]

Lee

[11] Patent Number: 6,108,922

[45] Date of Patent: Aug. 29, 2000

[54] CARTOON DRAWING APPARATUS HAVING AN AUXILIARY POSITIONING PLATE

[76] Inventor: Chin-Kun Lee, 1st. Fl., No. 10, Lane 45, Jiu-Lu-Tu St., San-Chung City, Taipei, Taiwan

[21] Appl. No.: 09/132,208

[22] Filed: Aug. 11, 1998

[51] Int. Cl.[7] ..... B41F 27/00

[52] U.S. Cl. ..... 33/430; 33/623; 33/613

[58] Field of Search ..... 434/85, 90, 87, 434/88, 89, 91, 92; 33/430, 613, 623, 32.7, 23, 18.3, 1 AA, 1 K

[56] References Cited

U.S. PATENT DOCUMENTS

| | | | |
|---|---|---|---|
| 2,711,031 | 6/1955 | Kessler, Jr. | 33/623 |
| 2,977,688 | 4/1961 | Redey | 33/1 K |
| 3,572,228 | 3/1971 | Ternes | 33/623 |
| 4,138,818 | 2/1979 | Hebel | 33/430 |
| 4,972,590 | 11/1990 | Dentith | 33/430 |
| 4,987,686 | 1/1991 | Ternes | 33/623 |
| 5,099,581 | 3/1992 | Svehaug | 33/430 |

FOREIGN PATENT DOCUMENTS

| | | | |
|---|---|---|---|
| 1306738 A1 | 4/1987 | U.S.S.R. | 33/18.3 |
| 1701572 A1 | 12/1991 | U.S.S.R. | 33/430 |
| 2190884 | 12/1987 | United Kingdom | 33/1 K |

*Primary Examiner*—Diego Gutierrez
*Assistant Examiner*—Maria Fernandez
*Attorney, Agent, or Firm*—Bacon & Thomas

[57] ABSTRACT

A cartoon drawing apparatus for 16 F size drawing paper, includes an auxiliary positioning plate which can reconfigure the apparatus for 12 F size drawing paper. The cartoon drawing apparatus for 16 F size drawing papers includes a round drawing disk, a frosted glass, an upper and lower positioning rulers. The frosted glass is embedded in the drawing round disk for an artist to draw thereon. The upper and the lower positioning rulers have positioning protuberances for fixing 16 F drawing papers. The auxiliary positioning plate includes some insertion holes on the upper edge of a plane body. The plane body includes some protuberances on the lower edge of the plane body, so that when the insertion holes are slipped over the positioning protuberances on the upper positioning ruler, the distance between the protuberances on the lower edge of the plane body and their corresponding positioning protuberances on the lower positioning ruler exactly matches the fitting of 12 F drawing papers on the apparatus.

4 Claims, 9 Drawing Sheets

CARTOON DRAWING APPARATUS HAVING AN AUXILIARY POSITIONING PLATE

BACKGROUND OF THE INVENTION

1. Field of the Invention

The present invention is related to an auxiliary positioning plate for cartoon drawing apparatuses, wherein a set of drawing apparatuses used only for cartoon drawing papers of 16 F (field) can suit cartoon drawing papers of 12 F as well.

2. Description of the Prior Art

The principle way of producing cartoons is to use drawing papers with grids to quickly project pictures onto a screen much like films so that the subject images in the pictures can be halted temporarily in the viewer's perception by the function of visual acuity to form continuous actions. Since the backgrounds other than the subjects in the pictures are mostly stationary, the static backgrounds need not necessarily be drawn repeatedly. As for the moving subjects, the first drawing paper and the second one can be overlapped. The slight moving actions of the subjects can be drawn in the second drawing paper which is then used as a reference to likewise draw further actions on the third drawing paper, and so on. The gradually changing movements of the subjects can be drawn one by one on the drawing papers. Thus a set of cartoon pictures are completed.

Using of a cartoon drawing apparatus is based on the above stated principles of overlapping and moving of the drawing papers during cartoon drawing. An artist can draw precise and suitable angles of displacements of subsequent figures based on the figure in a preceding drawing paper. The technical level involved will be described by using FIGS. 1 to 5 of the drawings which show the conventional cartoon drawing apparatuses.

As shown in FIG. 1, the conventional cartoon drawing apparatus includes a drawing round disk 10, a frosted glass 20, an upper positioning ruler 30 and a lower positioning ruler 40.

The drawing round disk 10 is excavated centrally to allow the frosted glass 20 to be embedded in the middle position thereof. The drawing round disk 10 is provided at the sides above and below the frosted glass 20 respectively with two parallel slide grooves 11 for sliding in respective upper and lower positioning rulers 30, 40 in a leftward or rightward direction.

The upper and lower positioning rulers 30, 40 are two long rulers of equal length; and are each provided respectively on the top surface thereof with a plurality of positioning protuberances 31, 41 which can be used to insert thereon a plurality of bores provided on the upper and lower edges of a drawing paper to lay the drawing paper down on the top surface of the frosted glass 20 for drawing.

To draw the moving actions in grids, a picture previously drawn on a drawing paper is used as a reference, and another blank cartoon drawing paper is fixed by the positioning protuberances 31, 41 and is lapped over the previous drawing paper. Then the artist needs to make slight changes on the subsequent drawing paper according to the picture of the former drawing paper. The pictures in the grids can thus show the sequential moving actions.

The above stated conventional cartoon drawing apparatus can satisfy the basic requirement of a drawer. However, there are many defects in the application thereof.

In drawing cartoons, there generally are two sizes for cartoon drawing papers, i.e., 12 F (field) and 16 F. In drawing close-ups of parts of heads or hands, or in drawing close-up scenes or medium distant scenes, cartoon drawing papers of 12 F are mostly used. When a further or wider scene is to be drawn, cartoon drawing papers of 16 F are mostly used. These two standards for drawing papers are different in size, and different in their conditions of use. When drawing TV cartoons, drawing papers of 12 F are mostly used and those of 16 F are rarely used. However in movies, drawing papers of 16 F are mostly used while those of 12 F are rarely used.

These two standard drawing papers were used for drawing on two different cartoon drawing apparatuses. As an example, the cartoon drawing apparatus depicted in FIG. 2 is for drawing papers of size 16 F, and the cartoon drawing apparatus depicted in FIG. 3 is for drawing papers of size 12 F, and the apparatuses are different in size. Therefore an artist has to buy two cartoon drawing apparatuses of different sizes. This not only raises costs, but is also problematic due to the repeated changing of drawing apparatuses during drawing.

FIG. 4 shows a conventional dual two purpose cartoon drawing apparatus which is made for drawing papers of size 16 F. By using upper and lower positioning rulers 30, 40 that are wider, and the positioning protuberances 31, 41 are closer to the borders of the frosted glass 20 such that the distance between the positioning protuberances 31, 41 of the upper and lower positioning rulers 30, 40 is closer and this apparatus can exactly match drawing papers of size 12 F.

As shown in FIG. 5, if the upper and lower positioning rulers 30, 40 on the dual purpose cartoon drawing apparatus are drawn out and the ends of each ruler reversed and then inserted back, the distance between the positioning protuberances 31, 41 of the upper and lower positioning rulers 30, 40 is longer, and this apparatus can then exactly match drawing papers of 16 F.

The advantage of the conventional two purpose cartoon drawing apparatus is that the artist does not have to buy two cartoon drawing apparatuses of different sizes, saving cost. However, the disadvantage is that it is problematic in operation to draw out and reverse the ends of the rulers and then reinsert the upper and lower positioning rulers 30, 40. FIG. 5 illustrates the problem. After reversing the ends of the upper and lower positioning rulers 30, 40, the upper and lower edges of a 16 F drawing paper lap over the tops of the upper and lower positioning rulers 30, 40 respectively. During drawing, the borders 32, 42 of the upper and lower positioning rulers 30, 40 on the drawing round disk 10 will reduce the drawing area and thus adversely influence the overall quality thereof.

SUMMARY OF THE INVENTION

An auxiliary positioning plate has several advantages when used with a drawing apparatus. The plate can increase working efficiency as well as drawing quality in drawing cartoons.

The auxiliary positioning plate of the present invention is designed for a cartoon drawing apparatus that can use 16 F drawing papers. A plurality of insertion bores is provided on the upper edge of a plane body, and correspondingly a plurality of positioning protuberances is provided on the lower edge of the plane body. When an auxiliary positioning plate is lapped over the round drawing disk of the cartoon drawing apparatus, and when the insertion bores are slipped over the positioning protuberances, the distance between the positioning protuberances and the lower positioning ruler can be reduced to allow the fixing of 12 F drawing papers such that the cartoon drawing apparatus for only 16 F drawing papers can also be used to fix and to draw on 12 F drawing papers.

The advantage stated above includes not only permitting the use of 12 F drawing papers with the cartoon drawing apparatus originally designed for 16 F drawing papers only, thereby reducing the cost to the artist, but adds the convenience of using, and doing away with the interference caused by the rulers that affect the quality of drawings.

The present invention will be more readily apparent in its particular structural and functions in the detailed description of the preferred embodiment and in reference to the accompanying drawings.

DETAILED DESCRIPTION OF THE PREFERRED EMBODIMENTS

Figure 1:
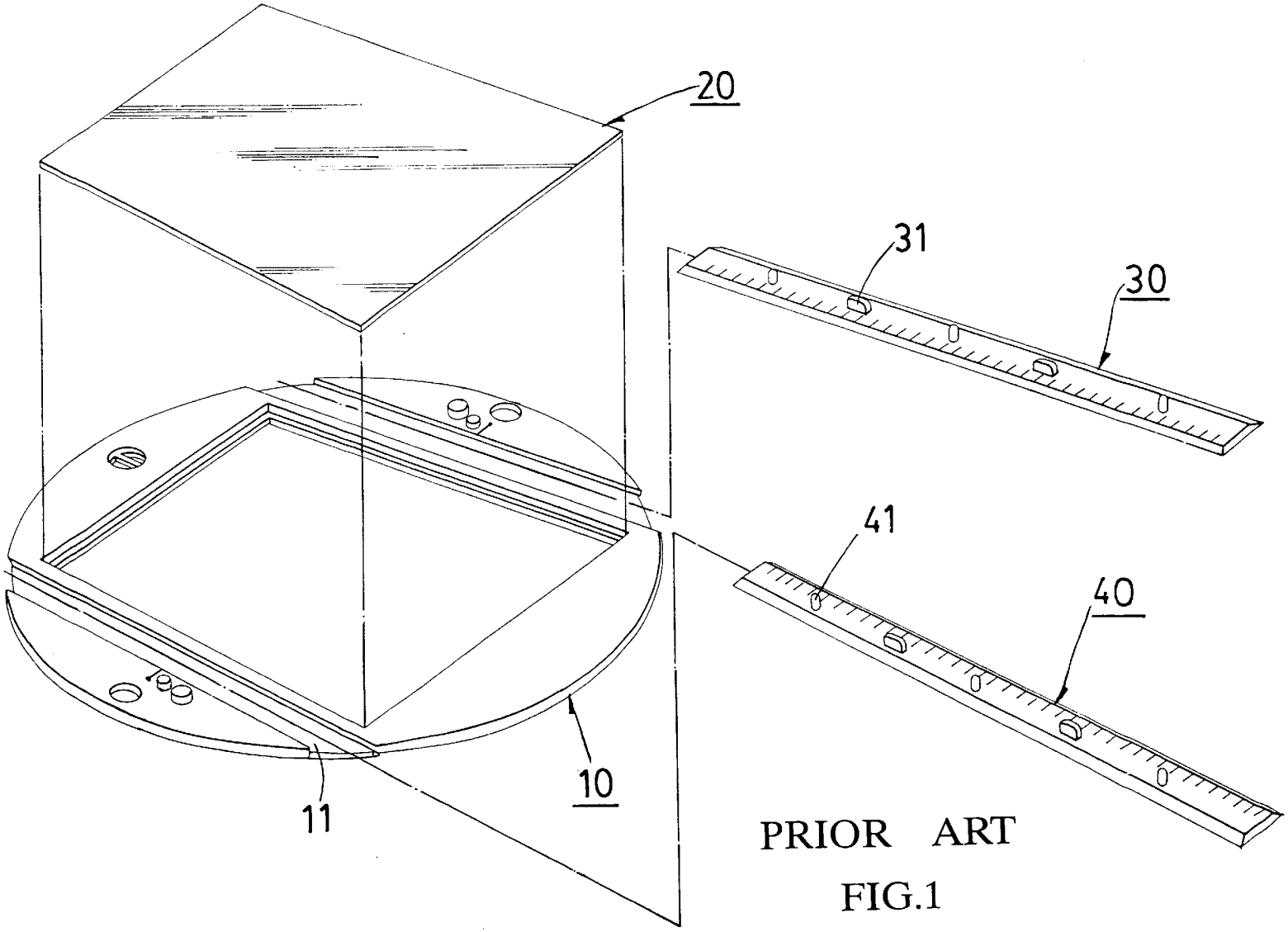
PRIOR ART FIG.1
FIG. 1. is an analytical perspective view of a conventional cartoon drawing apparatus.
Figure 2:
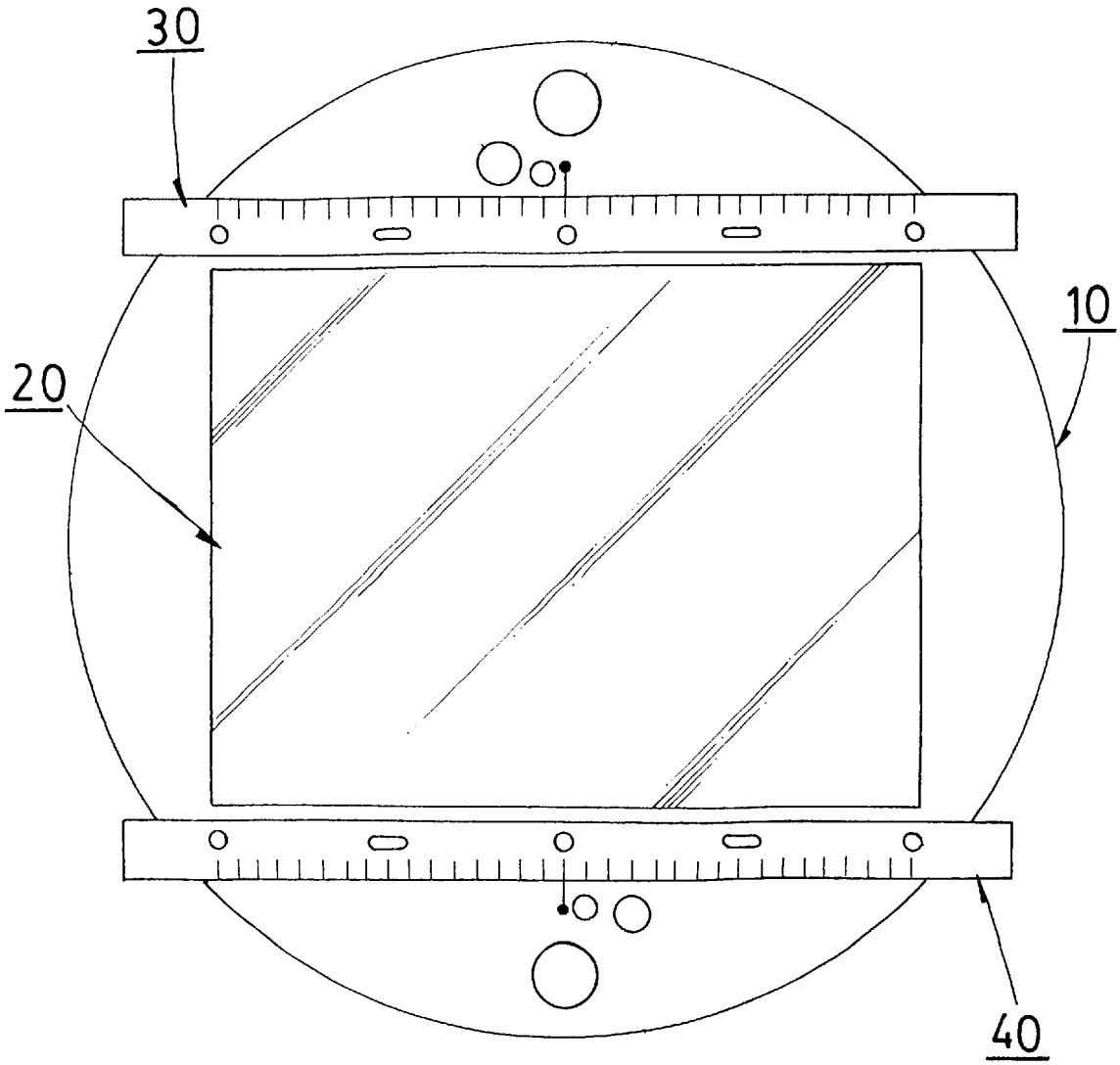
PRIOR ART FIG.2
FIG. 2 is a top view of the conventional cartoon drawing apparatus suitable for the cartoon drawing papers of 16 F.
Figure 3:
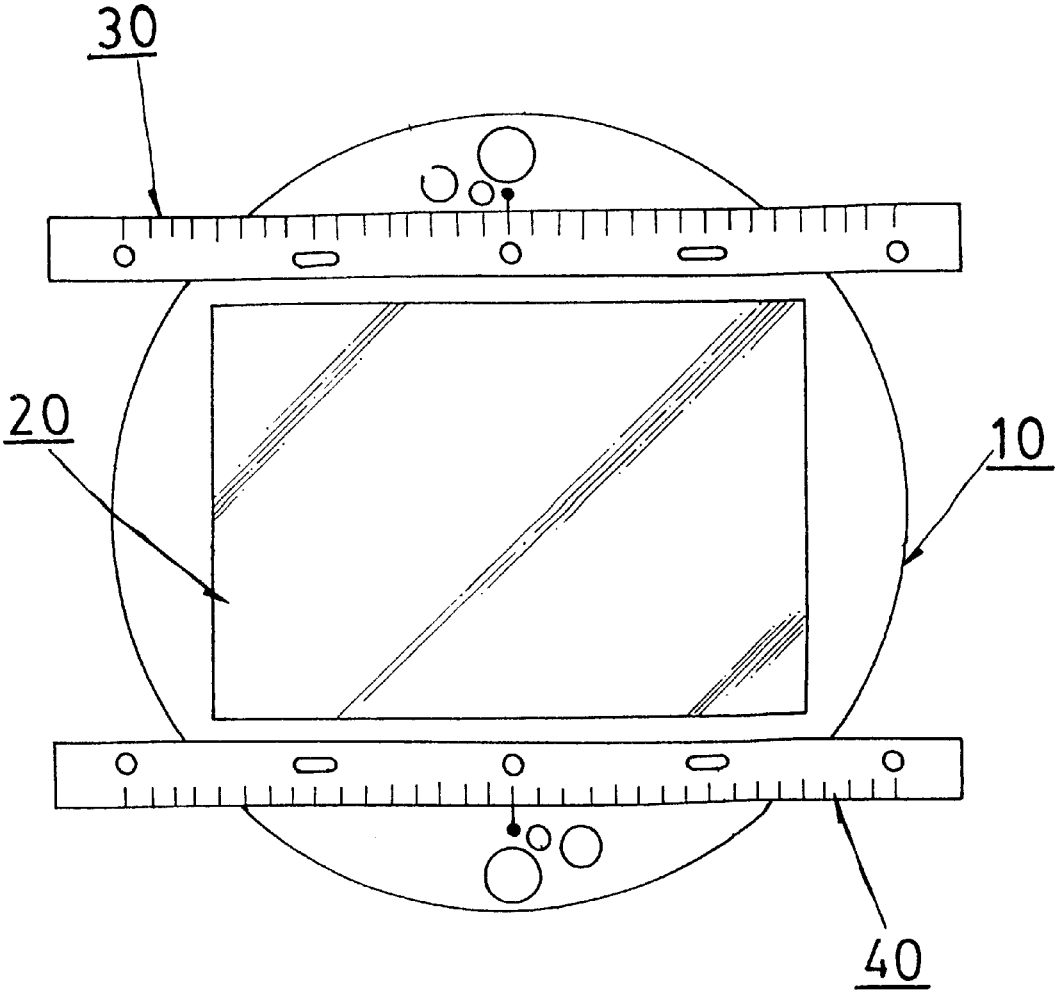
PRIOR ART FIG.3
FIG. 3 is a top view of the conventional cartoon drawing apparatus suitable for the cartoon drawing papers of 12 F.
Figure 4:
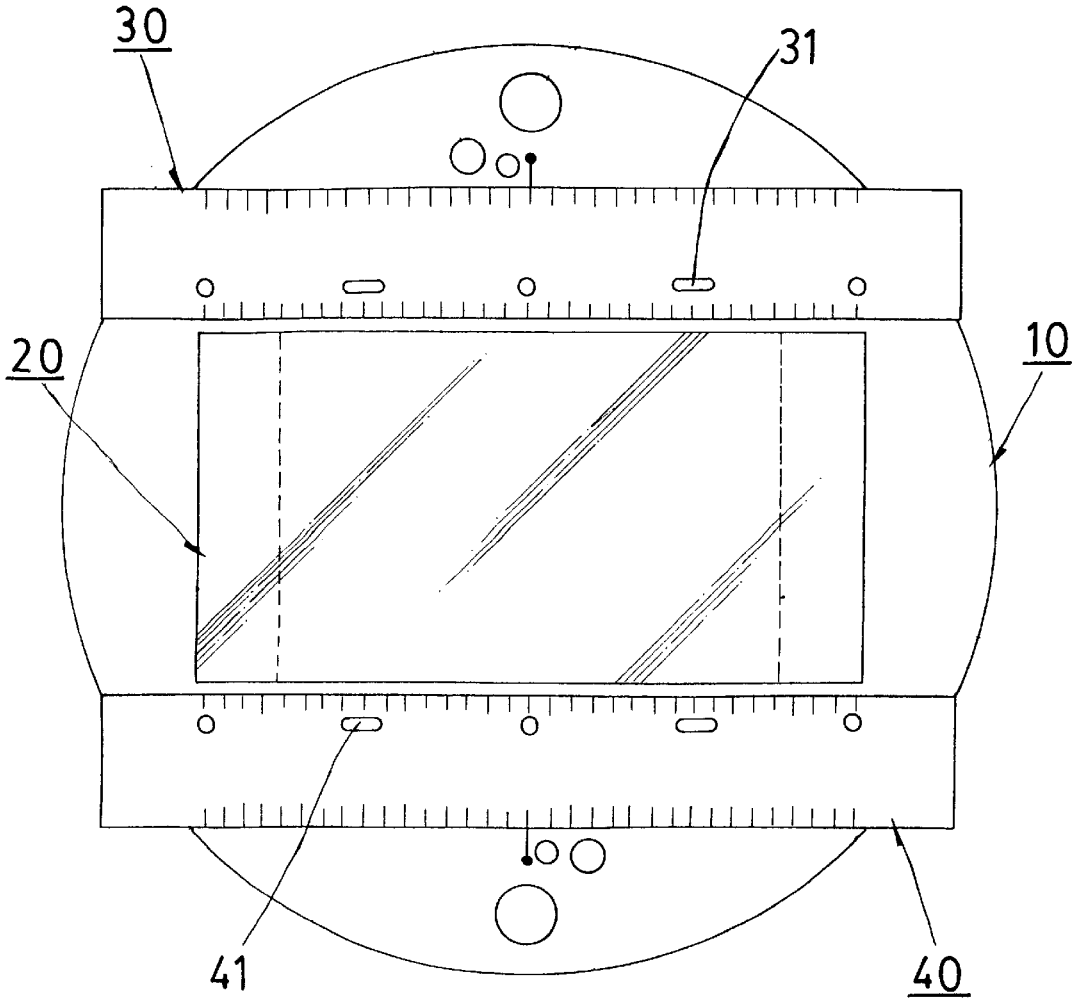
PRIOR ART FIG.4
FIG. 4 is a n analytical perspective view of the conventional two purpose cartoon drawing apparatus with a 12 F cartoon drawing paper thereon.
Figure 5:
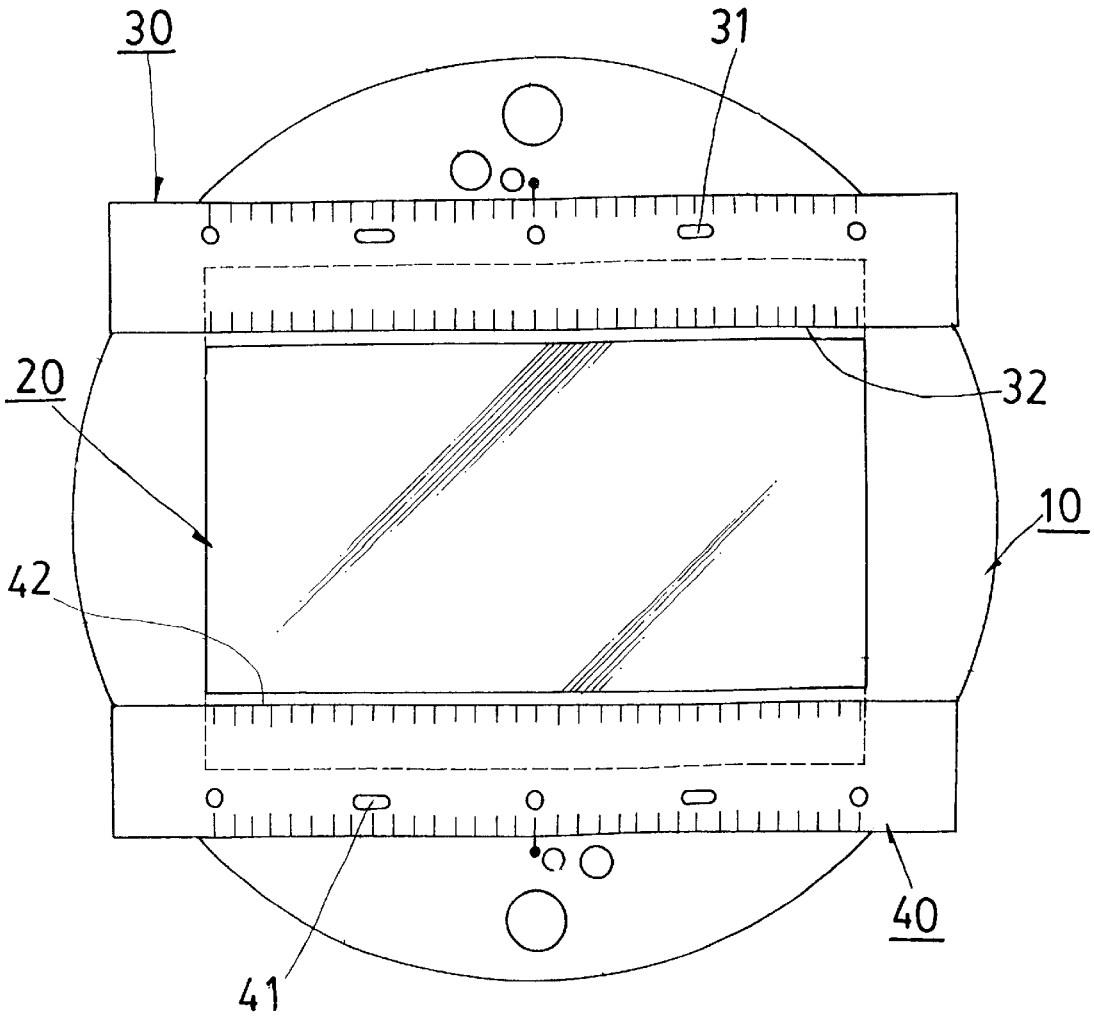
PRIOR ART FIG.5
FIG. 5 is a top view of the conventional two purpose cartoon drawing apparatus reconfigured for us with a cartoon drawing paper of 16 F.
Figure 6:
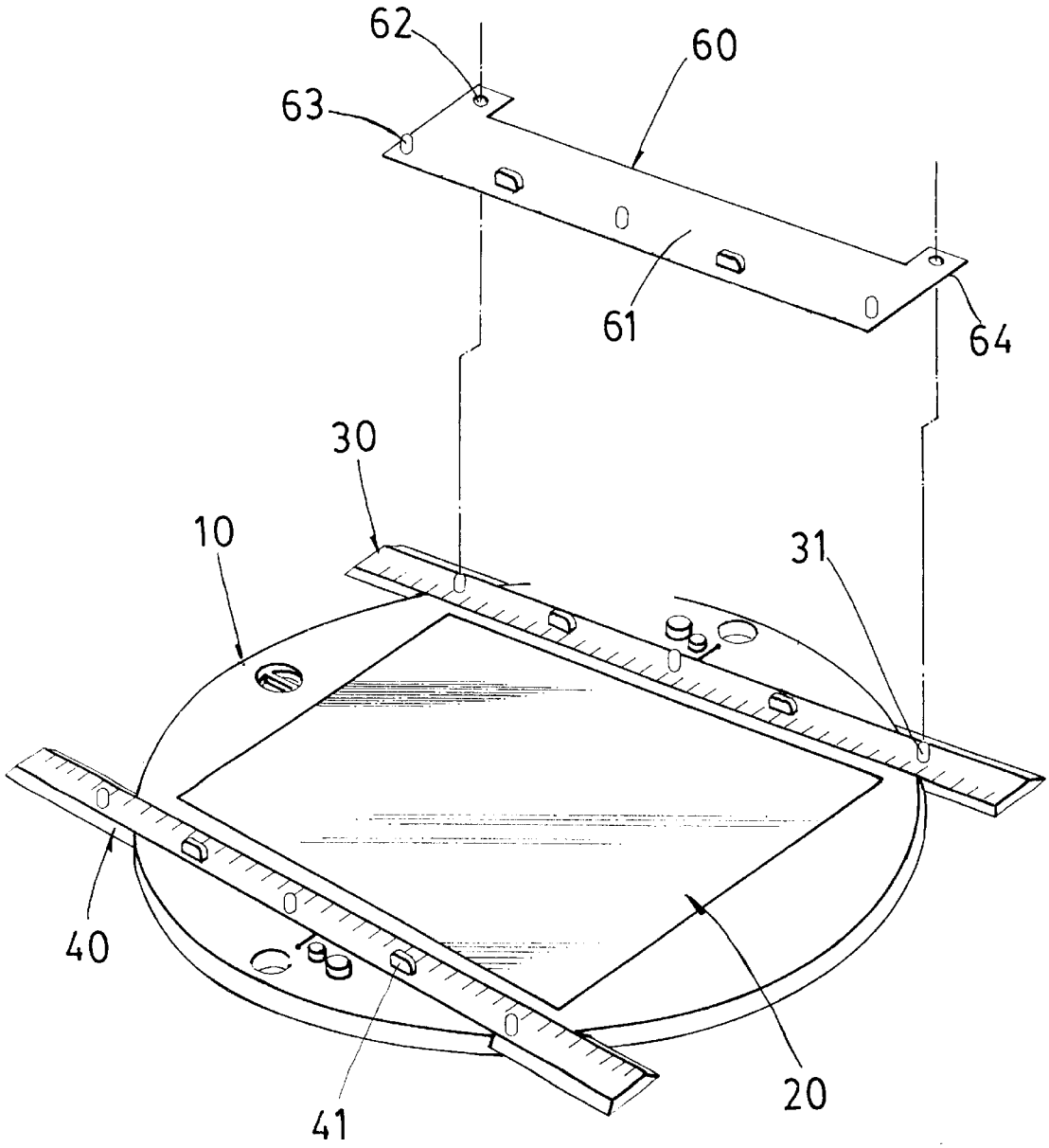
FIG. 6 is a perspective view off the present invention.

Referring first to FIG. 6, the auxiliary positioning plate of the present invention is designed TO FIT ON a cartoon drawing apparatus FOR 16 F drawing papers. The cartoon drawing apparatus for 16 F drawing papers includes a round drawing disk 10, a frosted glass 20, an upper positioning ruler 30 and a lower positioning ruler 40.

The drawing round disk 10 is excavated centrally to allow the frosted glass 20 to be embedded in the middle position thereof. An artist can draft and draw thereon. The upper and the lower positioning rulers 30, 40 are provided with positioning protuberances 31, 41 for fixing of 16 F drawing papers.

The auxiliary positioning plate 60 of the present invention is provided with a plurality of insertion bores 62 on the upper edge of a plane body 61 corresponding in position to a plurality of positioning protuberances 31 on the upper positioning ruler 30, and provided thereon a plurality of auxiliary protuberances 63 is provided on the lower edge of the plane body 61 corresponding to the positioning protuberances 31 on the upper positioning ruler 30.

Figure 7:
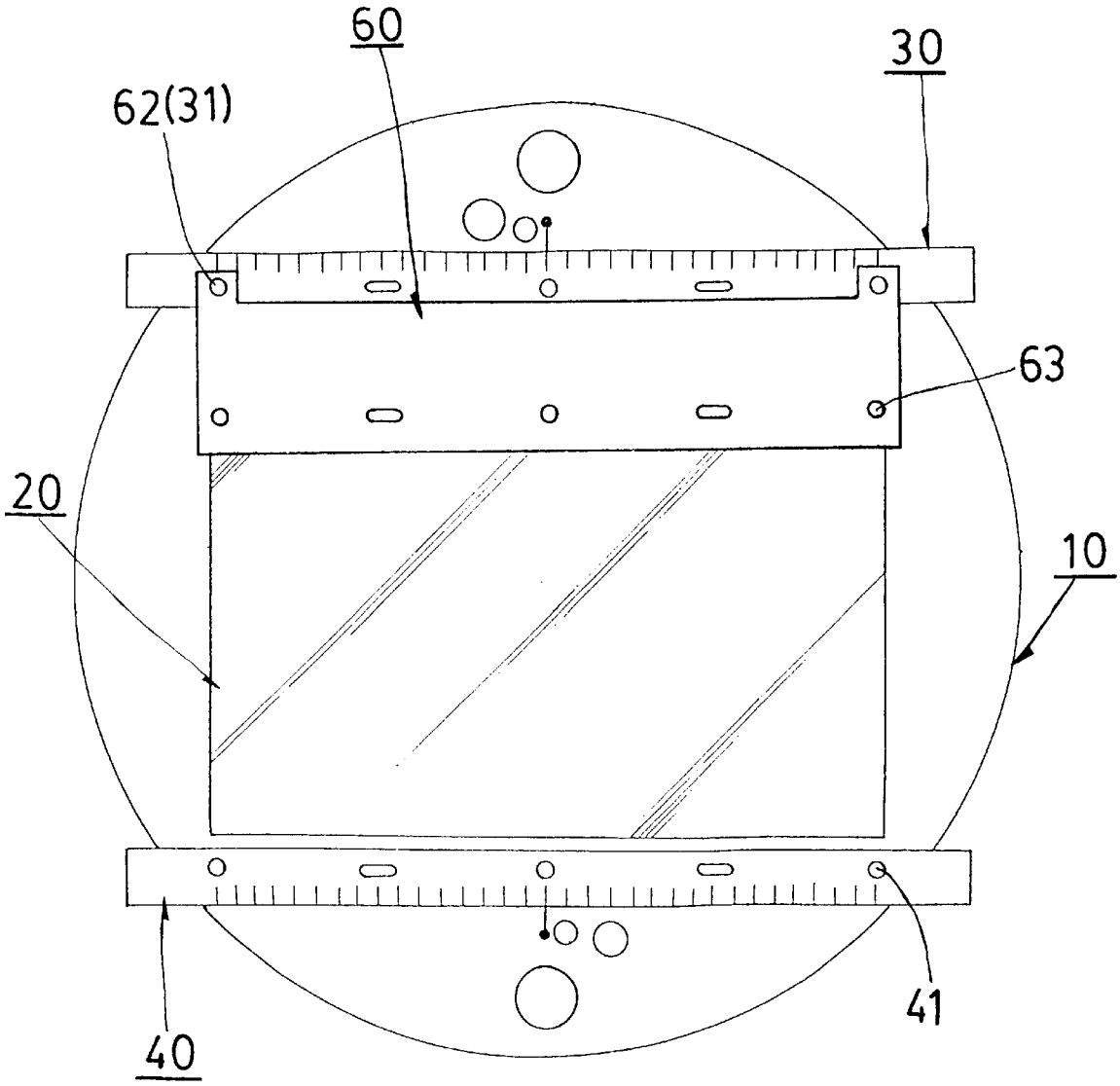
FIG. 7 is a top view of the present invention in use, showing the cartoon drawing apparatus suitable originally for cartoon drawing papers of 16 F reconfigured for cartoon drawing papers of 12 F after providing an auxiliary positioning plate of the present invention.

As shown in FIG. 7, when the plane body 61 of the auxiliary positioning plate 60 is lapped over the drawing round disk 10, the insertion bores 62 are slipped over the positioning protuberances 31 on the upper positioning ruler 30. Then the distance between the auxiliary protuberances 63 on the lower edge of the plane body 61 of the auxiliary positioning plate 60 and the positioning protuberances 41 on the lower positioning ruler 40 is reduced to permit the fixing of a 12 F drawing paper such that the cartoon drawing apparatus for 16 F drawing papers can be suitable for fixing and drawing on cartoon drawing papers of 12 F.

Two insertion bores 62 as shown in FIG. 6 are provided each on a protruding fixing piece 64 at either of the two ends of the upper edge of the plane body 61. A recess is formed between the two protruding fixing pieces 64 for receiving the positioning protuberances 31 on the upper positioning ruler 30 that is not inserted in any other insertion bore 62.

Figure 8:
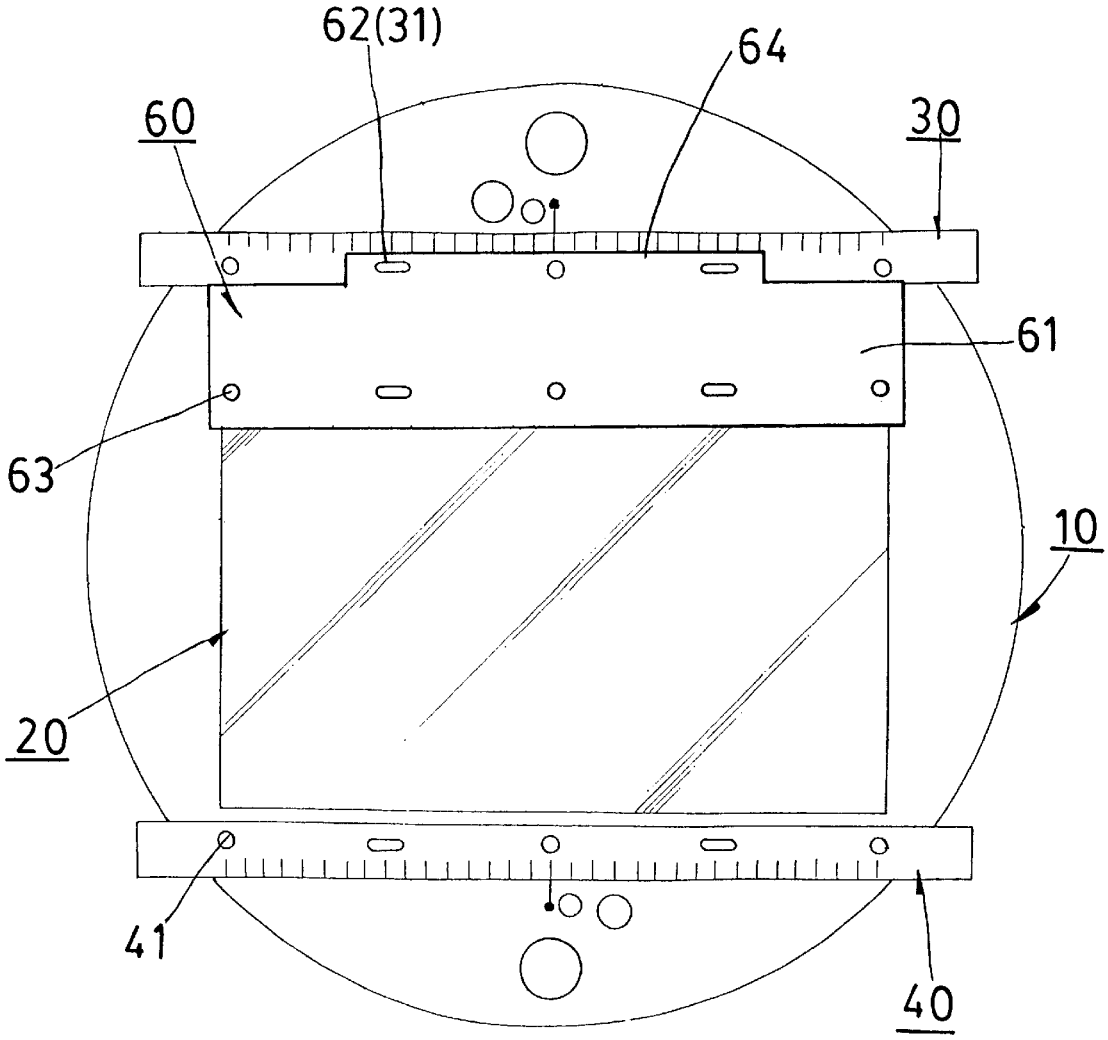
FIG. 8 is a top view of one embodiment of the present invention, showing a different arrangement of insertion bores thereon.

As shown in FIG. 8, a protruding fixing piece 64 for two insertion bores 62 can also be provided in the middle of the plane body 61 and protrudes outwardly.

Figure 9:
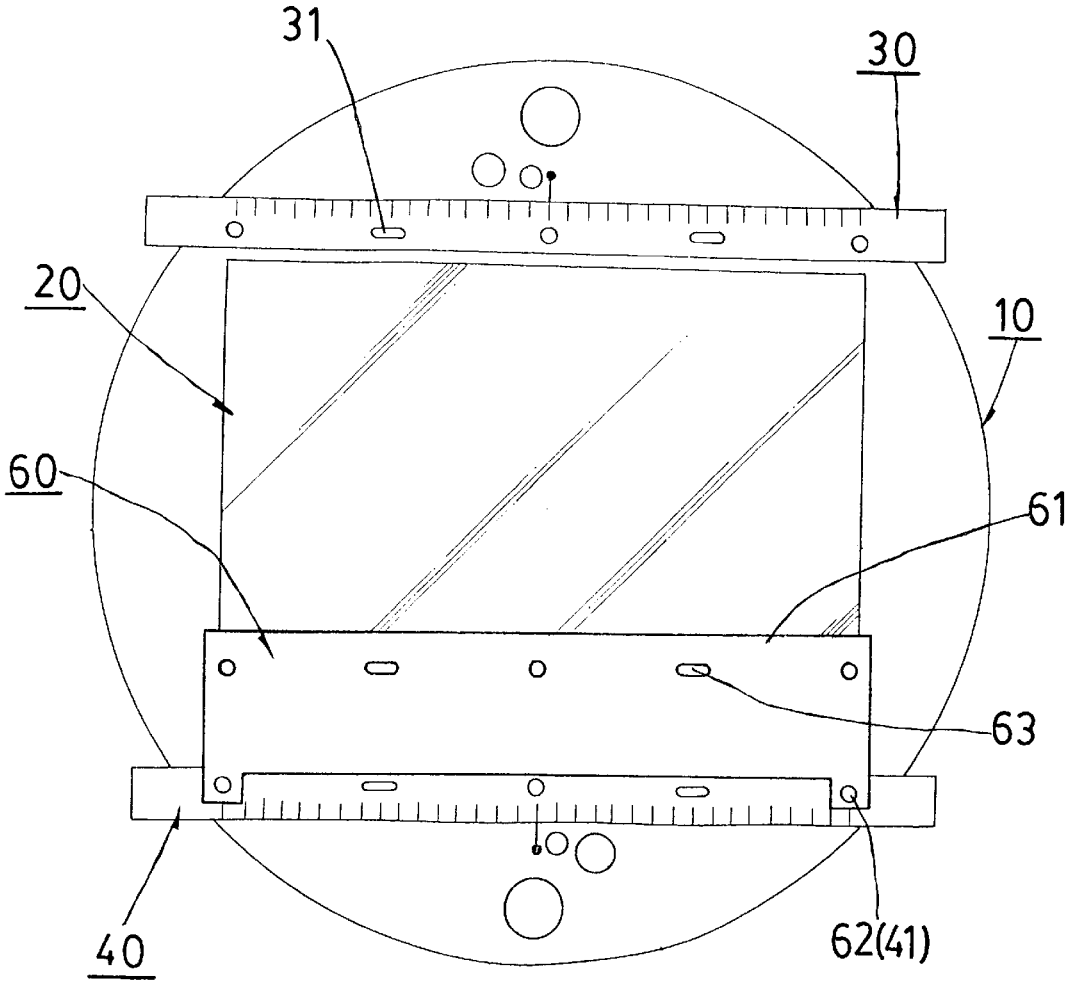
FIG. 9 is a top view of another embodiment of the present invention, showing that the auxiliary positioning plate can also be fixed on the lower positioning ruler.

As shown in FIG. 9, the insertion bores 62 of the auxiliary positioning plate 60 can also be slipped over the positioning protuberances 41 on the lower positioning ruler 40, and the auxiliary protuberances 63 on the lower edge of the plane body 61 originally are now on the upper edge of the plane body 61, with the distance between an auxiliary protuberance 63 and its corresponding positioning protuberance 31 on the upper positioning ruler 30 suitable for fixing of 12 F drawing papers.

The above stated structure of components and descriptions and drawings are only for illustrating preferred embodiments of the present invention, and is not to limit the scope of the present invention in any way. It will be apparent to those skilled in the art that various modifications or changes can be made to the elements of the present invention without departing from the spirit and principles of this invention. Accordingly, all such modifications and changes fall within the scope of the appended claims and are intended to be part of this invention.

What is claimed is:

1. Cartoon drawing apparatus for use with 16 F size drawing paper comprising:

a round drawing disk having an upper surface, the upper surface having a recess;

a frosted glass positioned in the recess of the upper surface of the drawing disk;

the round drawing disk further including a pair of parallel grooves positioned between the frosted glass, on the upper surface of the drawing disk;

an upper and lower positioning rulers each having one or more positioning protuberances extending from a surface thereof;

the upper and lower positioning rulers each slidingly positioned into respective one of the parallel grooves such 16 F size drawing papers are fixable on the positioning protuberances of the upper and lower positioning rulers;

an auxiliary positioning plate having a plane body and auxiliary protuberances on the plane body;

at least one protruding fixing piece laterally extending from the plane body, and having at least one insertion bore;

the auxiliary positioning plate detachably positioned on either one of the upper or lower positioning rulers via an interlock of the at least one insertion bore of the at least one protruding fixing piece and the at least one of the positioning protuberances of the respective positioning ruler;

the auxiliary positioning plate sized and configured such that when it is detachably positioned on one of the positioning rulers, the distance between the auxiliary protuberances on the plane body of the auxiliary positioning plate and the positioning protuberances of the ruler across the frosted glass from the auxiliary position plate permits the fixing of 12 F drawing papers on the positioning protuberances of the ruler across the frosted glass and the auxiliary protuberances of the positioning plate.

2. The cartoon drawing apparatus for use with 16 F size drawing paper as in claim 1, wherein, the at least one protruding fixing piece extends laterally from the ends of the longitudinal side of the plane body and a recess is formed between the protruding fixing pieces.

3. The cartoon drawing apparatus for use with 16 F size drawing paper as in claim 1, wherein, the at least one protruding fixing piece extends laterally from the middle of the plane body.

4. The cartoon drawing apparatus for use with 16 F size drawing paper as in claim 1, wherein, the auxiliary position plate configured so that it can be repositioned from being secured on the upper position ruler to the lower position ruler and vice versa.

* * * * *